US005842931A

United States Patent [19]

Payne

[11] Patent Number: 5,842,931

[45] Date of Patent: Dec. 1, 1998

[54] MIRRORED HEADGEAR SPORTS TRAINING SYSTEM

[76] Inventor: Edward D. Payne, 2321 Harvard Dr., Arlington, Tex. 76015

[21] Appl. No.: 798,094

[22] Filed: Feb. 12, 1997

Related U.S. Application Data

[60] Provisional application No. 60/011,473 Feb. 12, 1996.

[51] Int. Cl.[6] ..... A63B 69/36

[52] U.S. Cl. ..... 473/208; 473/210; 473/211; 473/274; 473/453; 473/458; 359/856; 359/860; 273/DIG. 30

[58] Field of Search ..... 473/208, 209, 473/210, 211, 240, 274, 452, 453, 458, 267; 359/856, 860; 273/DIG. 30

[56] References Cited

U.S. PATENT DOCUMENTS

| | | | |
|---|---|---|---|
| 2,494,000 | 1/1950 | Robertson | 35/29 |
| 3,000,261 | 9/1961 | Frenkel | 88/74 |
| 3,097,437 | 7/1963 | Harrison | 35/29 |
| 3,110,495 | 11/1963 | Carter | 273/35 |
| 3,917,278 | 11/1975 | Steinman | 273/183 E |
| 4,181,307 | 1/1980 | Krene | 273/183 |
| 4,307,885 | 12/1981 | Pidcock | 473/210 |
| 4,383,687 | 5/1983 | Wolff | 273/35 A |
| 4,678,193 | 7/1987 | Kronogard | 273/186 |
| 5,015,084 | 5/1991 | Kryder | 473/267 X |
| 5,116,058 | 5/1992 | Theriault | 273/183 E |
| 5,174,566 | 12/1992 | Kelnhofer | 473/267 |

*Primary Examiner*—George J. Marlo

[57] ABSTRACT

A mirrored device which allows the athlete to observe his motions as he performs. Specifically as this invention relates to golf, the system trains these fundamentals: steady head control; correct alignment; proper golfing posture; the proper swing paths for the backswing and downswing. These goals are accomplished by: a large mirror to reflect the golfer's side that is opposite the direction he is driving the ball, this mirror is comprised of a diagram and moveable, adhesive strips which serve as visual guides for instillment of the mentioned fundamentals; a pair of angularly arranged mirrors which are supported by a visored headgear that the golfer wears.

The user adjusts the small angled mirrors for sighting himself. Following the charting of his proper backswing and downswing planes with the moveable strips, he guides his club, and hands along the relection of these strips with the purpose of memorizing the feel of these correct motions. The golfer then focuses both eyes on the ball and swings at the ball with rememberance of the proper swing paths.

15 Claims, 8 Drawing Sheets

MIRRORED HEADGEAR SPORTS TRAINING SYSTEM

This application claims the benefit of U.S. Provisional application Ser. No. 60/011,473, field Feb. 12, 1996.

FIELD OF INVENTION

The present invention relates generally to athletic equipment and more partically to an optical golf training device.

BACKGROUND OF THE INVENTION

Golf is a game in which form is emphasized over athletic ability. Proper fundamentals must be learned in order to develop the coordinated movements which enable a golfer to swing a golf club within the proper backswing plane for a consistent return of the club to the ball along the desired swing path. There is a need for a device which teaches fundamentals necessary to achieve these desired results.

The golfer must learn to master complex components of the golf swing: a correct and steady head position; proper golfing posture; proper body alignment; and the correct backswing and downswing planes. The fact that the golfer cannot visually observe himself while he is swinging, makes improvement through self training difficult.

A mirror provides a view of the swing. However, the inability of the golfer to see his swing while maintaining a head and neck position that is proper for the eyes to focus on the ball is an obstacle in developing these fundamentals.

Practice techniques using video cameras have helped to alleviate certain elements of this problem. However, they have limited effectiveness because they do not provide the golfer real time feedback.

The golfer must be presented with the tools which reinforce the correct head position, the proper golfing posture, the proper body aim or alignment, and the correct backswing and downswing planes for the club to follow while observing his swing in progress. An optical means with adaptable swing guidelines for accommodating golfers of various heights is a needed device for kinesthetic development of the proper golfing movements.

A search for prior art did not disclose any patents that read directly on the claims of the instant invention. However, the following U.S. patents were considered related:

Harrison in U.S. Pat. No. 3,097,437 employs a triangulation of mirrors for self analysis of the swing. Although this device does provide real time feedback, the invention doesn't have visual guidelines for corrections in swing mistakes. Moreover, a frontal view as provided by this device does not adequately allow detection of swing flaws related to posture, alignment, and swing planes.

Carter in U.S. Pat. No. 3,110,495 uses seperately mounted mirrors disposed near a golf tee arranged such that his entire image is visible enabling him to study his position and movements while addressing and hitting the ball. Although this device allows a golfer to view his swing while focusing his eyes on the ball, the invention does not provide any definitive aides to help the golfer in the building of the proper golfing fundamentals.

Prior art of Steinman, U.S. Pat. No. 3,917,278, and Therrialt, U.S. Pat. No. 5,116,058, offer some visual aides, but like Harrison they only render to the golfer a frontal view of his swing.

U.S. Pat. No. 5,174,566 issued to Kelnhofer describes an apparatus that consists of a mirror which has a diagram imprinted on it. The diagram enables a golfer to swing his club along its guidelines. While this device may serve as a useful tool, it doesn't employ adjustable swing plane lines which is necessary for accurately adapting to golfers of various heights and different length clubs. Moreover, this is not a device that allows the proper head positioning that is required during the driving of the ball.

Kryder discloses in U.S. Pat. No. 5,015,084 an arrangement of mirrors for golf improvement including a gridded mirror for putting. Again, however, only a frontal view is provided.

It is accordingly most desirable that a means be provided whereby a golfer can observe and direct his movements in accordance with proper form while addressing and actually hitting the ball while maintaining a head and neck position that is proper for the eyes to focus on the ball.

SUMMARY AND OBJECTS OF INVENTION

It is the main object of this invention to provide a mirror device which will permit a golfer to observe and correct his swing without requiring any head or neck movement liable to disagree with any body attitude or movement specified as being the correct one for a particular purpose. A related object is the provision of a training aide for golf and eventually other sports where self-observation may be helpful.

With particular reference to golf, the present invention trains a golfer: in the proper shoulders and feet positions; in the proper golfing posture; in the proper head position; and in the correct muscular movements needed to swing within the proper swing planes.

Accordingly, another object of the present invention is for a golfer to practice and observe his complete swing while maintaining the proper and stationary head position.

In accordance with this invention, these and other objects are achieved by a novel golf practice device comprised of: a large diagrammatically gridded mirror that is elevated and disposed with its reflective plane reflecting the side of a golfer which is opposite the direction for driving the ball; two moveable strips; one of which to plot and visualize the back swing plane; the other of which to chart and visualize the downswing plane a small pair of angularly arranged mirrors which are in view of the golfer while he performs through the support of a headgear that he wears.

Another object of this invention is to provide a golfer a means for viewing his feet, hips and shoulders while positioning himself to strike a golf ball.

A further objective of the present invention is to provide a means for a golfer to view his body, the club, the ball, and the flag when propelling the ball within 50 meters.

Another object of the present invention is to allow a golfer to align his backswing to the proper backswing plane.

Another object of the present invention is to allow a golfer to consistently duplicate proper golfing back posture.

Another object of the present invention is to allow a golfer to observe his movements for propelling the ball while maintaining a steady and proper head position during the course of the swing.

Another object of the present invention is to provide a means for a A golfer to observe his body,the club, the ball and the hole when chipping.

Another object of the present invention is to allow a golfer to observe his body,the putter,the ball, and the hole when putting.

A further object is to provide such a device which will be readily transportable for indoor and outdoor practicing.

Because of this advantageous use, this device is described as especially constructed and arranged for such use. However,as will become apparent, there are other equally advantageous uses. Accordingly, the detailed description of this apparatus is not intended to be limited.

Other objects and advantages of the present invention will become apparent and obvious from a study of the following description and the accompanying drawings which are merely illustrative of such an invention.

BRIEF DESCRIPTION THE DRAWINGS

DESCRIPTION OF PREFERRED EMBODIMENT

Figure 1:
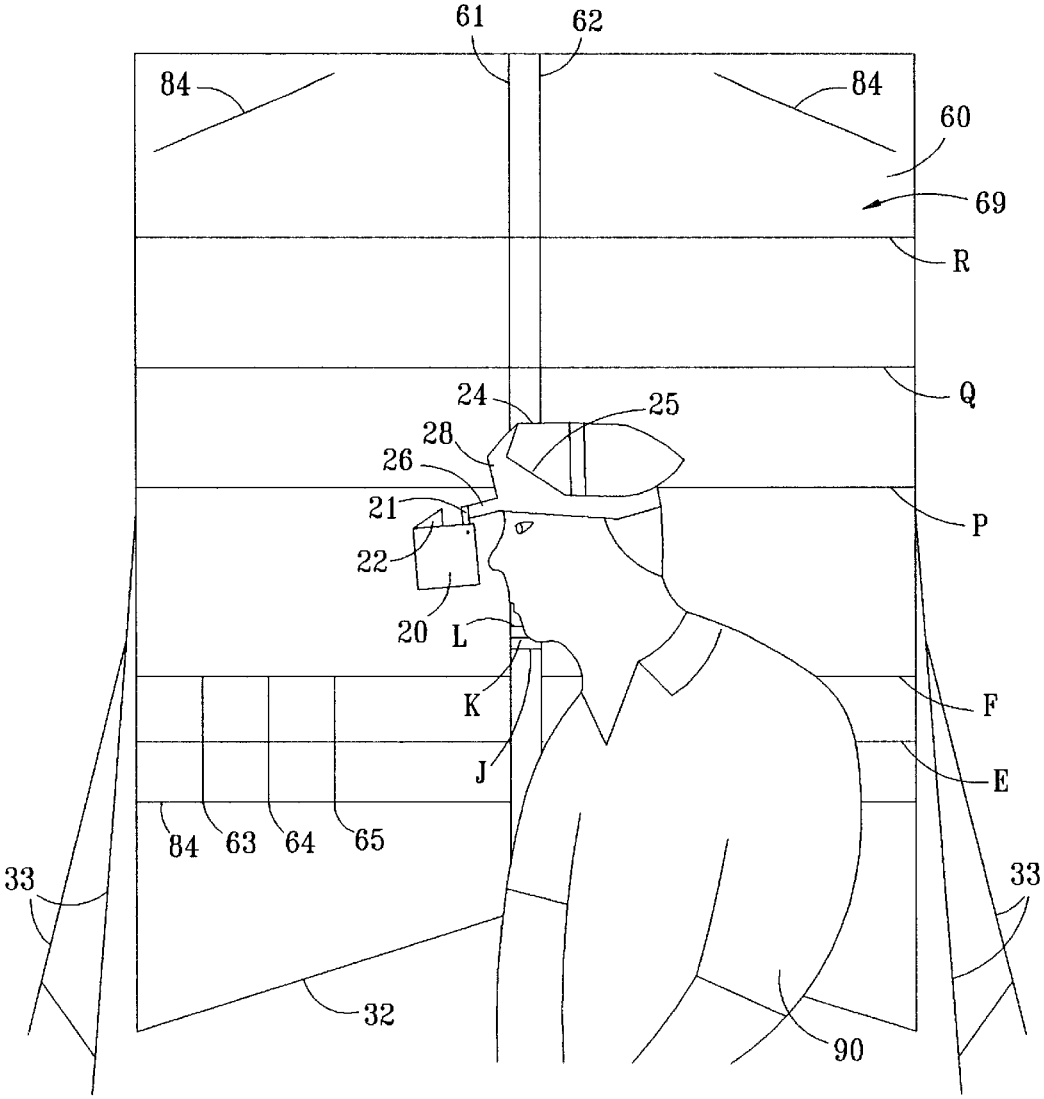
FIG. 1 is a frontal elevation of system of invention according to a preferred embodiment and showing a golfer wearing a mirrored headgear in a perspective view.

Although the present invention is a device to help athletes in the self teaching of manual skills involving coordinated movements, the preferred embodiment which is illustrated in FIG. 1 specifically relates to golf.

Albeit this apparatus can aide a golfer in many manners, the particular goals are to assist a golfer in proper golfing posture, proper alignment, a proper head position, and the correct backswing and downswing planes.

These goals are achieved by these things: a large reflecting surface, for example, a mirror 60, with a diagram superimposed thereon; a pair of angularly arranged mirrors 20 and 22, which are supported by a headgear 24 that the golfer wears; two adhering moveable strips, one of which is used to help the golfer visualize his backswing plane, the other for visualizing the proper downswing plane.

Figure 3:
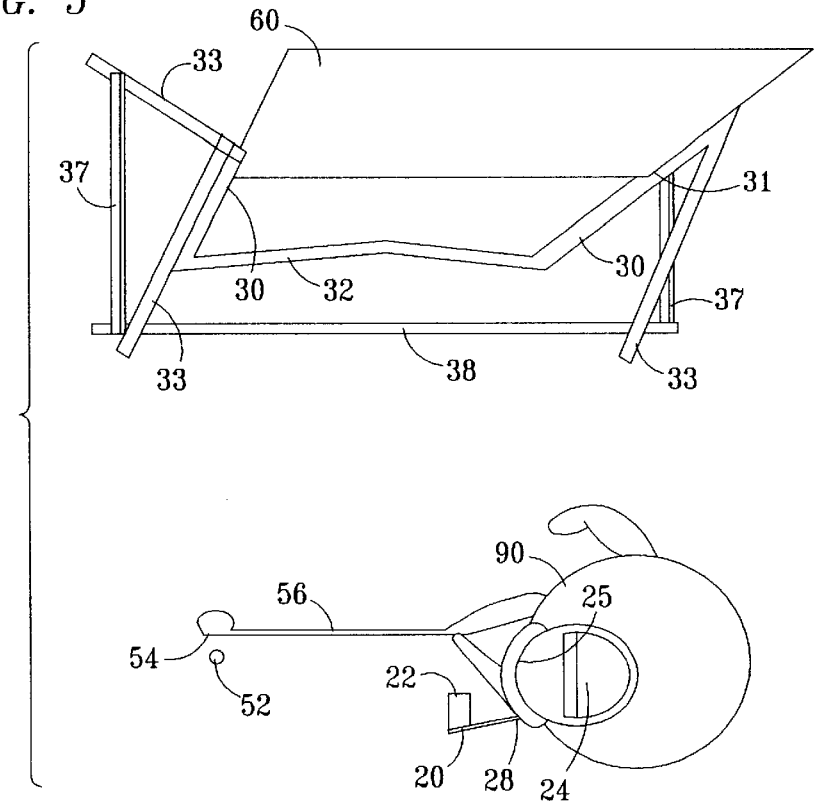
FIG. 3 is a top view of the golfer using the present invention.

As illustrated in FIG. 3, mirrors 60, 20, and 22 operate when properly oriented with respect to the golfer 90, and a ball 52, and respect to one another, to reflect the image of the golfer so that it may be seen by him while concentrating his eyes on the ball. This is accomplished by the above mentioned triangulational arrangement of the mirrors with the user. Basically, righthanded golfer 90, positions himself in front of mirror 60 so that his right side is reflected thereon. Angularly arranged mirror member 20 is disposed on headgear 24 so that the light rays emanating from mirror 60 are directed thereon. The rays are thence directed from mirror 20 onto mirror 22 whose plane intersects with mirror 20's plane within an approximate angular spacing of 58 degrees. Finally, the rays are reflected from mirror 22 into the eye of the golfer, giving him a full view of his swing while performing.

Although these mirrors can be made of glass, a high impact plastic for example acrylic, polycarbonate, or styrene is preferrable because of these materials durability and lightness.

Figure 5:
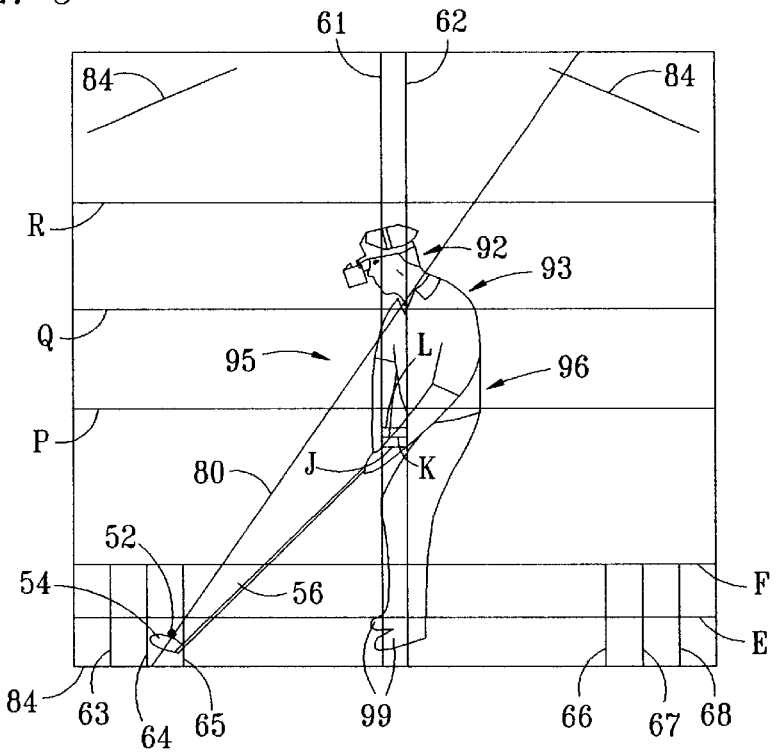
Figure 6:
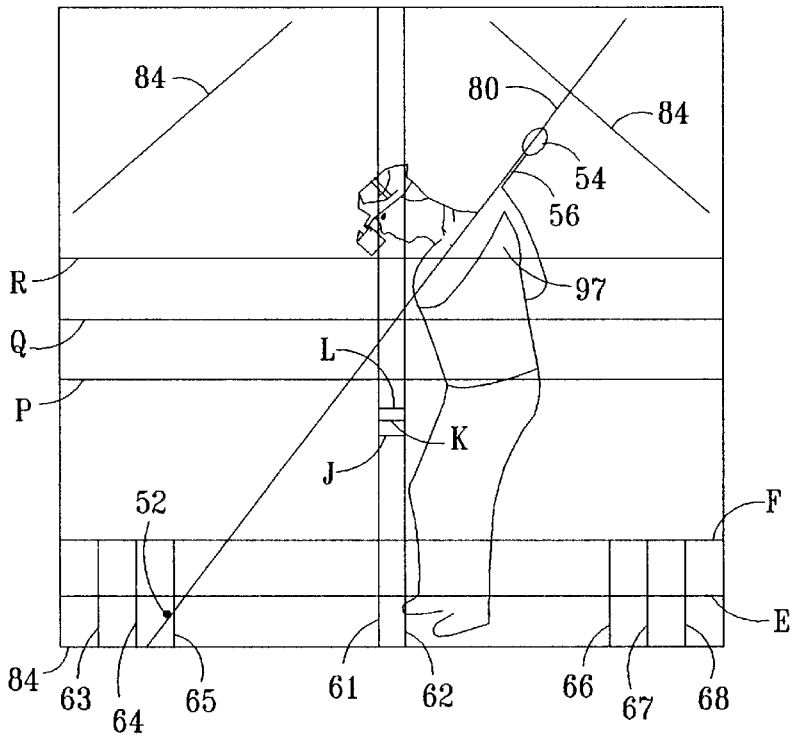
Figure 7:
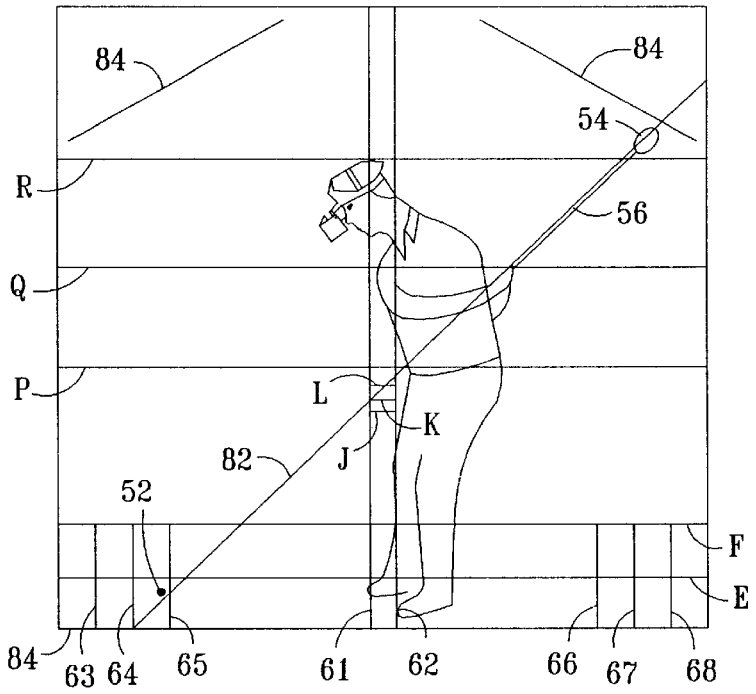

The reverse sided image that the golfer sees when using the device is depicted in diagrammatic FIGS. 5–7. As illustrated in FIG. 6, line 80, which may be made for example of hook material which adheres to loop material 84, aides the golfer in visualizing the proper backswing plane. This plane inclines upward from the ball,with its extention passing through the upper extents of the golfer's shoulders as detailed in FIG. 5. Because the amount of inclination of this plane is dictated by the golfer's leg length, arm length, and club length, an adjustable line such as strip 80 is necessary for accuracy in charting. It is the righthanded golfer's goal to direct his left arm 97, which is his leading arm, a clubshaft 56, and clubhead's face 54 along this strip 80 during the last one third of the backswing.

Figure 2:
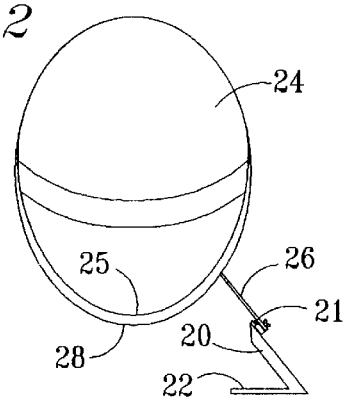
FIG. 2 is a top view of the mirrored headgear.

As illustrated in FIG. 2, the headgear 24 is comprised of a visor 25, a visor plate 28, and a vertical adjustment support 21, which are all preferrably made of plastic. The visor plate has an arm 26 which extends horizontally outward from the headgear for providing adequate spacing of the mirrors from the face while sufficiently positioning mirror 22 to allow the golfer a clear view of the ball. Attached to the visor plate arm is the vertical support finger, or vertical adjustment support 21. Although this component generally functions as a vertical adjuster for mirrors 20 and 22, it can provide further spacing of the mirrors from the face by pivotting into a horizontal position. Nonetheless, the main function of this support is to provide an adjustment for these mirrors with respect to the vertical.

A diagram 69 which is on the mirror 60's surface is depicted in FIG. 1, and FIGS. 4–7. Basically, this configuration is comprised of vertical and horizontal lines and accompanying numerals and letters for: correct alignment of the shoulders and feet; for proper posturing; and for accurate charting of the backswing and downswing planes. Vertical lines 61 and 62 spaced approximately 3 cms. apart, establish alignment points for the golfer's feet 97, shoulders 95, verterbrae prominence 93 or nape of the neck, and external occipital prominence 92 or back of the head. Horizontal lines P,Q,R work in conjuction with vertical lines 61 and 62 in assisting the user for defining these points latitudinally. Horizontal lines L,K, and J, which are placed between vertical lines 61 and 62 serve as guidelines for proper golfing posture. These lines are spaced approximately 5 cms. apart and function as measurement markers providing for the proper amount of torso lowering when the golfer flexes his knees. Horizontal lines E,F, and G work in conjunction with vertical lines 63,64,65, and 66,67, 68 to form a grid for accurately identifying a point of reflection for the ball 54.

These diagrammatic guidelines 69 may be either stenciled onto the mirror's surface or stenciled onto a highly plasticized transparent sheet for example polyvinylchloride, or static cling vinyl, which is a form of vinyl with adherent properties when placed on smooth surfaces. Thus the present invention functions effectively with a diagrammed sheet of static cling vinyl placed on a smooth reflective surface, for example a sliding glass door, although the preferred embodiment utilizes a large plane mirror 60 made of high impact plastic which is encased in a folding frame assembly 40.

Figure 4:
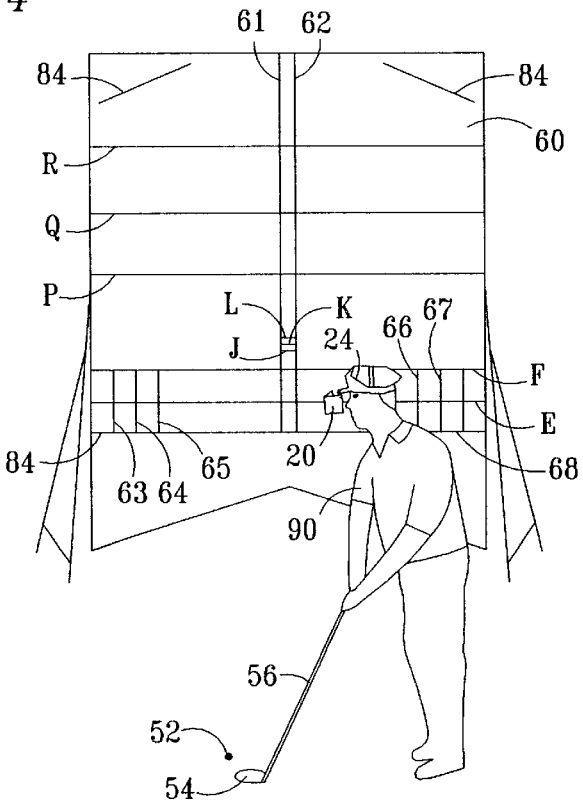
FIGS. 4–7 are diagrams illustrating the use of the preferred embodiment by the golfer standing in front of mirror 60.
Figure 8:
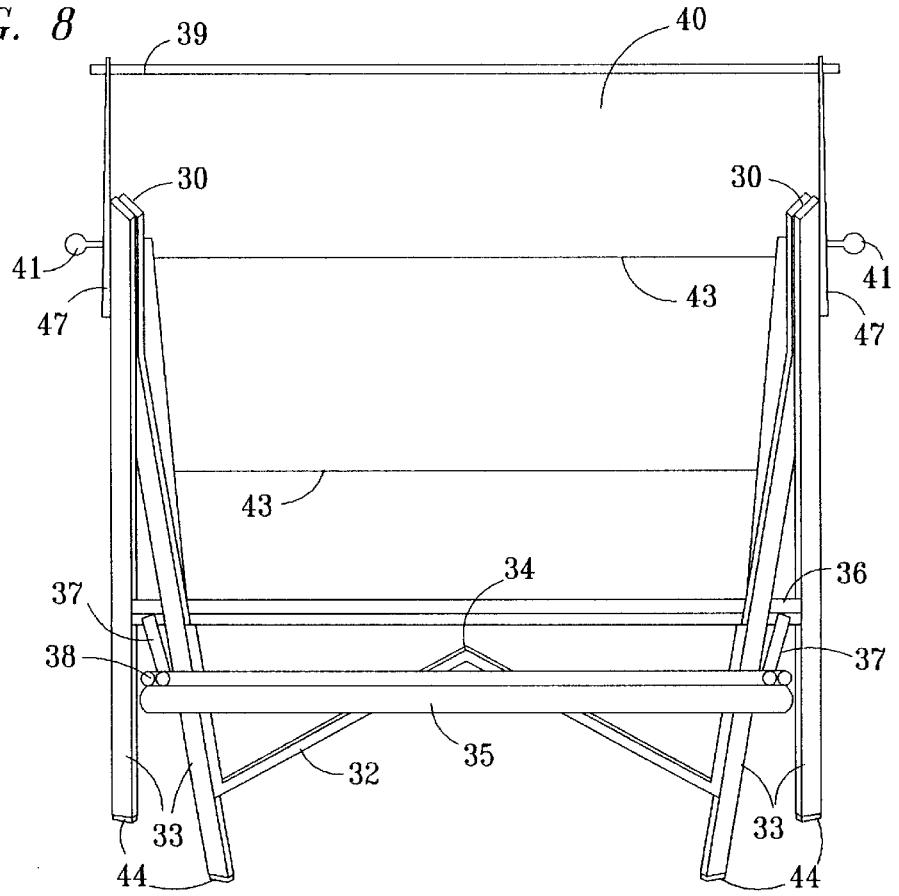
FIG. 8 is a front view of a mirror assembly 40 which generally houses mirror 60.
Figure 10:
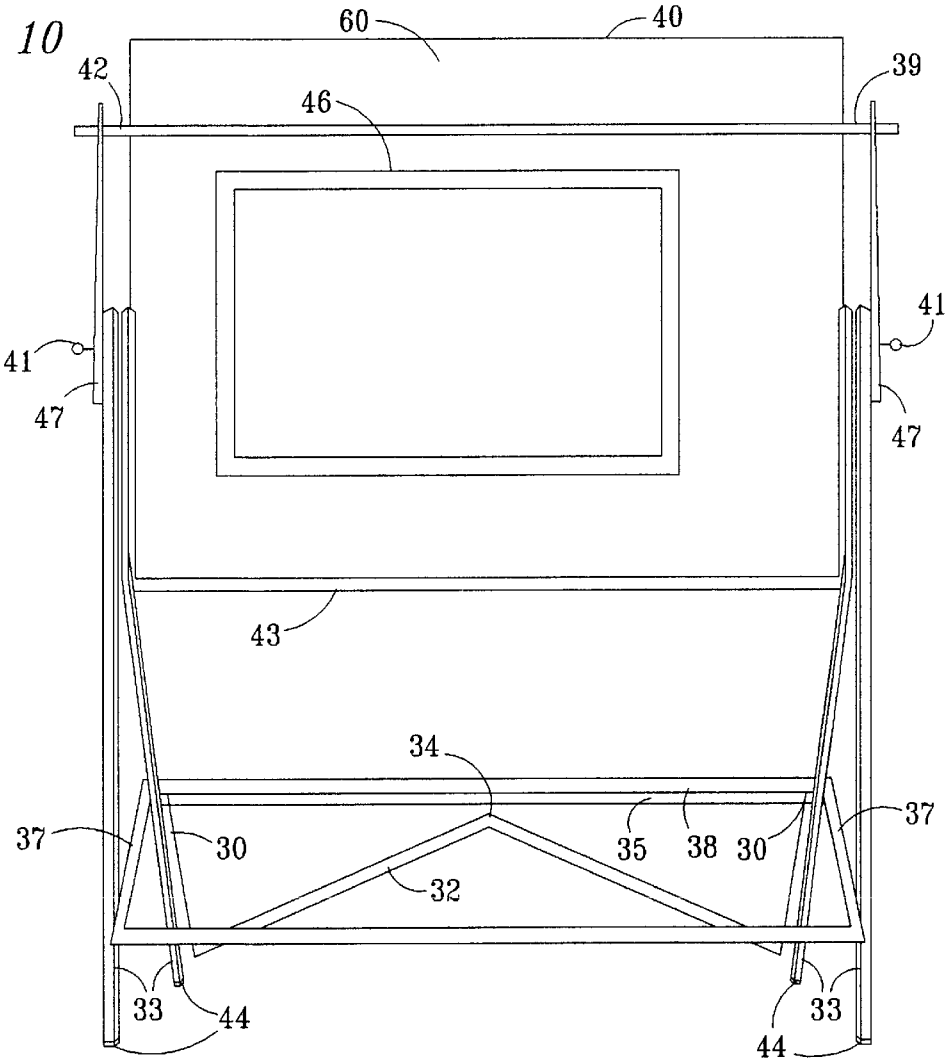
FIG. 10 is a rear view of mirror assembly 40 supporting an elevated mirror 60.
Figure 9:
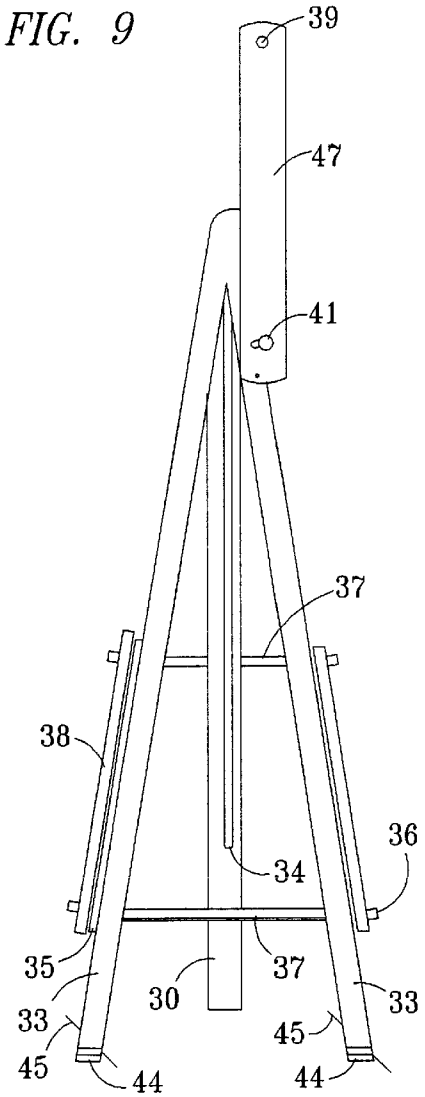
FIG. 9 is a side view of mirror assembly 40.

As illustrated in FIGS. 1, 4, and 10, the folding frame assembly 40, which is preferrably made of aluminum or plastic,is comprised of slotted sides 30 and a bottom 32 that collapses when the device is deployed. The sides are lipped facing inward for establishing front and back encasement for the mirror's outer edges. FIG. 8,which is a depiction of assembly 40 without a mirror, and the rear view in FIG. 10 exemplify the value of these lips in the devices utilization and transport. The frame assembly side view in FIG. 9 depict the position of the slots 31 whose lowest recesses support the lower corners of mirror 60 when the apparatus is deployed. The sides 30 are compressed toward each other by elastic cords 43 which are attached to the side's lips approximately 12 mms. beyond slot's 31 upper and lower extremities.

The assembly frame's upwardly lipped, hinged bottom 32 nestles inside of the lower ends of sides 30 for promotion of pivotting upward from their riveted attachment points. After the mirror has been raised by sliding its edges skyward approximately 60 cms., the jointed bottom 34 collapses upward to form an anticline when prompted by the golfer's foot. The result of this pivotting from the bottoms ends and its hinged middle withdraws the sides 30 at their lower extremes to a narrower width for enabling the side's slots to accomodate the mirror's outer edges and support the mirror at its lower corners. The deployment of the supported raised mirror promotes a full body reflection of golfers of varying heights.

Connected to the frame's sides approximately 4 cms. from its open end, are a pair of legs 33. These legs fold out one forward and one backward respectively, to support the frame when the device is deployed. The length of the legs 33 in contrast to the length of the sides 30 positions the frame's bottom approximately 3 cms. above the ground. This provides a pivotting of the frame for adjustment of the mirror's surface relative to the vertical.

A flat horizontal crossmember 35 connects to the front legs anterior at approximately 28 cms. from the legs'bottom and extends sufficiently beyond the legs to support a pair of axle arms 37 when the legs are opened. The axle arms 37 join to a handle's 38 ends at the assemblies front and a rear horizontal crossmember's 36 ends in the back to form a rectangular arrangement which is pivotally connected to the rear legs and encompasses the front legs for promoting rotable movement of the handle while governing the extent that the front legs open. The handle moves rotationally out and downward for deployment and up and in during the folding of the legs for transport.

Support for the upper extents of the mirror's back when elevated is provided by a U-shaped contrivance comprised of a pair of ears 47 which are approximately 60 cms. long and pivotally attached to the outer sides of the rear legs respectively and a horizontal crossbar 39 which axially attaches to the ears 47 other ends. The U-shaped component is rotated upward to position crossbar 39 adjacent to mirror's back. The ears 47 are locked by pins 41 at various points for bracing the adjustment of the mirror's angle relative to the vertical. Support for the mirror's front in this proximity is provided by an elastic cord 42 which stretches in front the width of the mirror and connects to crossbar 39.

Although the legs are made of hollow tubing, the legs'lower ends have a solid plastic material for example polyethelene inserted within and rubber tips 44 enveloping. The legs have angled holes drilled front to back in this proximity for accomodating stakes 45 which provide stability when the device is used outdoors.

BRIEF DESCRIPTION OF OTHER EMBODIMENTS

Figure 11:
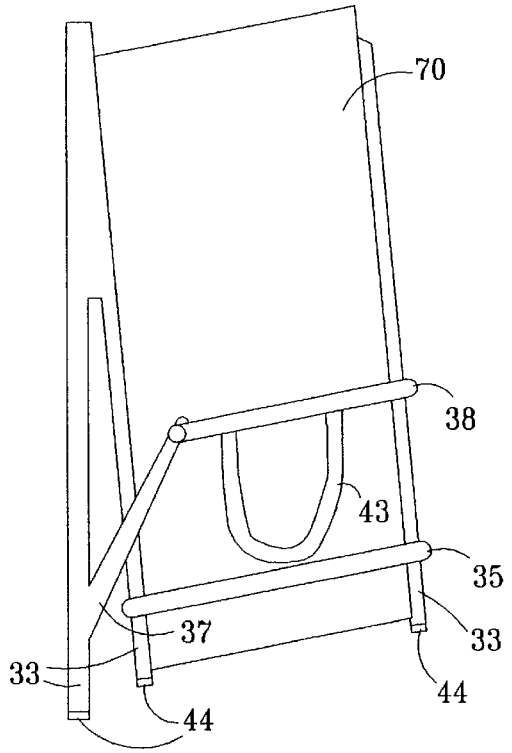
FIG. 11 is a perspective view of an embodiment of narrower width collapsed into package for convenient transporting and storing.
Figure 12:
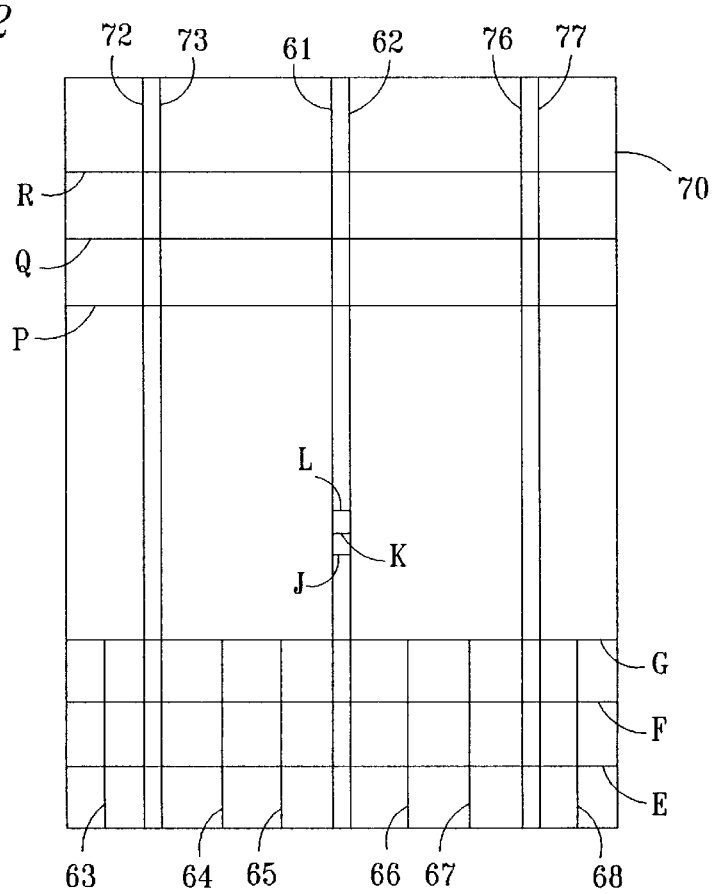
FIG. 12 is a frontal elevation illustrating a diagram 79 which is a schematic arrangement of lines on mirror 70.

Eventhough the preferred embodiment which utilizes mirror 60 affords the user with particular advantages for example ample space for reflecting the ball position and the clubhead when at its zenith point during the backswing, a narrower embodiment, illustrating mirror 70 in FIG. 10 and its diagram in FIG. 11 presents advantages for example ease in transport with the addition of strap 49. A further advantage of a narrower mirror 70 is a diminished need for the ribbing depicted in FIG. 10 in securing the mirror's 60 plane for accurate optical reflection As depicted in FIG. 12, a diagram 79, which goes on mirror 70, includes 3 pair of vertical guidelines with an approximate 3 cms. spacing between each pair. Vertical guidelines 72 and 73 are for the alignment of a lefthanded golfer's shoulders and toes, and 76 and 77 for the alignment of a righthanded golfer's shoulder's and toes.

BRIEF DESCRIPTION OF DIAGRAMMATIC FIGURES

FIGS. 4–11 inclusively illustrate the steps for usage of the preferred embodiment. It should be noted that FIGS. 5–7, which are diagrammatic views, illustrate the reverse sided image that the golfer sees when using the device.

Basically, FIG. 4 illustrates golfer 90 sighting his image within the right member of the angular pair of mirrors which rest on the head gear 24 while standing erect and holding the club in the left hand only.

FIG. 5 illustrates: proper alignment of the golfer's shoulders, feet, and vertabra principe with respect to vertical lines 61 and 62; and proper posturing with respect to lines L, K, and J; and plotting proper backswing plane using moveable strip 80 for connecting the point where the ball 52 is reflected and a point where the right shoulder is reflected.

FIG. 6 illustrates the golfer 90 directing his left arm, clubshaft, and clubhead face to align parallel to strip 80.

FIG. 7 depicts the golfer 90 aligning the clubshaft 56 and clubhead 54 and hands to the proper downswing plane which is charted by strip 82.

Procedure for Golfer 90 Using Preferred Embodiment

1. Righthanded golfer 90 placing right side approximately 150 cms. from and facing mirror 60 and while standing erect with the club in the left hand, position the front part of the feet on vertical lines 61 and 62; align the left shoulder on line 61 and the right shoulder 95 and verterbrae prominence 93 to line 62; position the external occipital prominence 92 within the parameters of these two lines.

Figure 15:
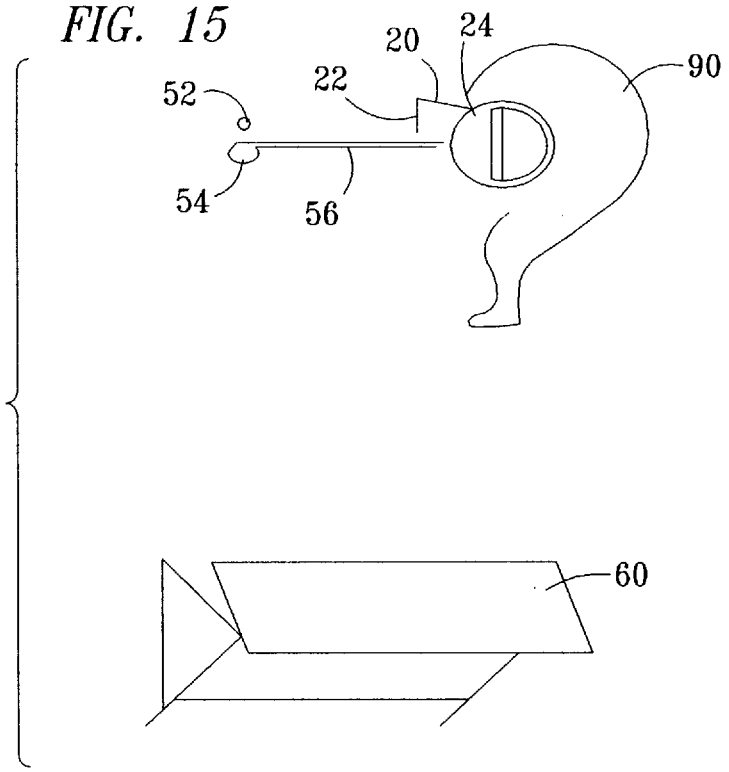
FIG. 15 is a top view of a left handed golfer using the device.
Figure 16:
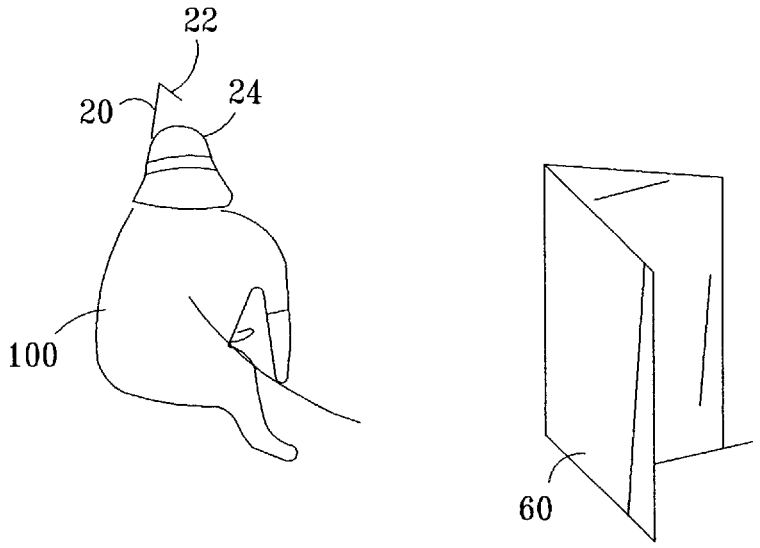
FIG. 16 is a top view of a baseball pitcher using the device for the training of pitching.

A lefthanded golfer reverses this by positioning his left side facing mirror 60 and positioning his right shoulder on line 62 and his left shoulder and vertebrae prominence on line 61. The positioning of a lefthanded golfer's left side to mirror 60 is depicted in FIG. 15.

2. While maintaining the positions of the shoulders 95, vertebrae prominence 93, and external occipital prominence 92 with respect to vertical lines 61 and 62, place right hand on clubhandle and lower torso approximately 5 cms. with the flexing of the knees; accurate lowering is accomplished by using the posture measure lines L, K, and J which are spaced 5 cms. apart.

3. After the placement of ball 52 in front of clubheadface 54, note: the point where the ball is reflected within horizontal lines E and F and vertical lines 63, 64, and 65; and a point where the right shoulder 95 intersects with line 62. Connect these two points with strip 80.

4. Swing the club back while aligning the left arm 97, clubshaft 56, and clubheadface 54 with strip 80 during last part of the backswing.

5. Chart the downswing plane by: connecting strip 82 to the point where the ball is reflected within the same gridded lines; and a point where the right shoulder blade 96 is reflected. The use of horizontal lines Q, P, and R assist in charting the accurate point for the shoulder blade.

6. With the backswing and downswing planes correctly plotted,first align the left arm 97, the clubshaft 56, and the clubhead face 54 to strip 80 during the last half of the backswing, then align the clubshaft 56 and clubhead face 54 to strip 82 during the first half of the downswing with the hands being guided along this strip to the ball. Repeat these motions several times with a purpose of memorizing the feel of these proper movements. Finally, focus eyes on the ball and drive it. Procedure for Using Device for Putting 1. Adjust the angle of the mirror assembly with respect to the vertical to reflect the ball 52 and the hole 58 in mirror 60.

2. Place the ball approximately three meters from hole.

Figure 13:
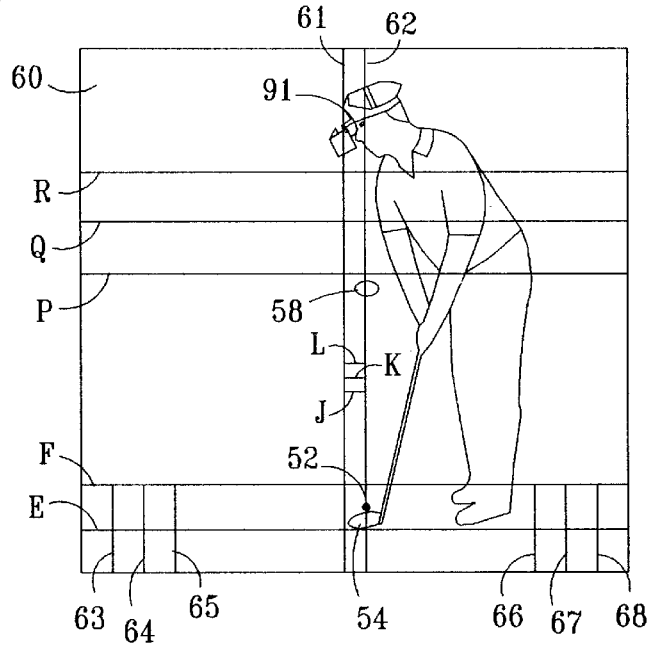
FIG. 13 is a diagrammatic side view of the golfer using the device for putting.

3. Position mirrror 60 so that line 62 is bisecting the ball 52 and hole 58 as illustated in FIG. 13.

4. Position eyes and putterhead 54 on line 62.

5. While sighting image in righthand member of angled mirrors, if putting righthanded, swing the putter back while maintaining putterhead 54 online 62 during the backswing and forwardswing of the puttingstroke. The establishment of a steady image in the mirror member assures a steady body and head position which are tenets in the art of putting. Procedure for Using Device for Propelling Ball 52 Within Fifty Meters 1. Adjust assembly 40 angle with respect to the ground for mirror 60 to reflect the ball 52 and flag 59.

Figure 14:
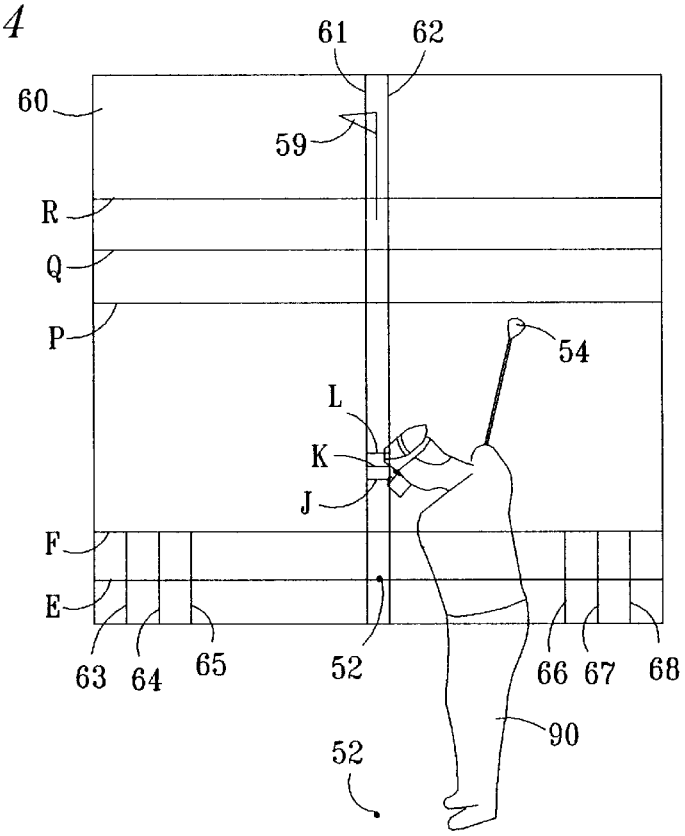
FIG. 14 is a side view of the golfer using the embodiment of narrower width for hitting a ball to a flag of short range.

2. Position mirror 60 to reflect ball 52 and flag 59 within vertical lines 61 and 62 as illustrated in FIG. 14.

3. While sighting image, ball 52, and flag 59 within right member of angled mirrors, swing the clubhead 54 back and forward to propel ball 52 toward flag 59. Procedure for Using Embodiment Which Utilizes Narrower Mirror 70

1. Align shoulders and toes to vertical lines 76 and 77, with the right shoulder and vertebrae prominence on line 77 and the left shoulder on line 76 for a righthanded golfer or vertical lines 72 and 73 with left shoulder and vertebrae prominence on line 72 and right shoulder on 73 for left handed golfer.

2–6. Proceed with the steps 2–6 as forementioned above in the Procedure for Using Device in the Preferred Embodiment. Procedure for Using Device for Training of Baseball Pitcher 100

1. Position front to face mirror 60 as illustrated in FIG. 15.

2. After turning head 90 degrees toward the intended target sight image in mirror 22 for observing pitching movements.

While I have shown and described both a preferred and other embodiments of the invention together with suggested procedures for their use this is by way of illustration only and does not constitute any limitation on the invention since there are various changes, deviations, revisions and departures which may be made from these embodiments and procedures without avoiding the scope of this invention as defined in the appended claims.

I claim:

1. Sports training apparatus comprising: a large substantially reflective surface wherein said surface is disposed to reflect an athlete's image; at headgear support means for a pair of angularly arranged mirrors; wherein a member of said pair is so disposed that the light rays emanating from said reflective surface are directed horizontally onto the said mirror member; wherein the angular spacing between said pair of angular mirrors is within a range of an acute angle and is so arranged that light rays reflected from said mirror member are directed horizontally onto said member's mate; therewith positioning of said mate is in full view of the user as he performs.

2. The apparatus of claim 1 wherein said headgear support means comprises:

(a) a harness means to envelop an athlete's head;

(b) a visor with an attachment means for connecting the visor to the said harness means;

(c) a visor plate with a rivetting means for attaching across the said visor's front;

(d) wherein the said visor plate is further comprised of a support arm horizontally extending outward from the said visor establishing adequate spacing of the said pair of mirrors from the athlete face while allowing a clear view of a ball;

(e) wherein the support arm's end is connected to the upper end of a vertical attachment support; wherein said vertical attachment support's lower end is connected to said pair of mirrors for adjustably establishing vertical positioning of said pair.

3. Apparatus in claim 1 wherein said reflective surface is a mirror with a diagram thereon and is disposed to reflect a golfer's side which is opposite the direction he is driving a ball.

4. Apparatus in claim 3 wherein said diagram comprising;

substantially vertically straight guidelines 61 and 62 for the location of a golfer's body while standing in front of said guidelines; wherein vertical guideline 61 defining a space for the location of a righthanded golfer's left shoulder and left toes, and vertical line 62 a defining space for the location of a righthanded golfer's vertebrae prominence, right shoulder and right toes vertical straight guidelines 61 and 62 for the location of a lefthanded golfer's body while standing in front of said guidelines; wherein vertical guidelines 62 defining a space for the location of a golfer's right shoulder and right toes, and vertical line 61 defining a space for the location of a golfer's vertebrae prominence, left shoulder, and left toes substantially horizontal straight lines R, Q, and P establishing a latitudinal point for a golfer's shoulders and vertebrae prominence equidistant vertical spacing of substantially horizontal straight guidelines L, K, and J establishing measure points for a golfer lowering his body into a proper golfing posture horizontal grid lines E and F and vertical grid lines 63, 64, 65, 66, 67, and 68 defining a space for the location of a ball moveable strip 80, with an adhesive means, directing the alignment of a club and establishing a guide during the final phases of the backswing for the arm which is nearest in proximity to the direction of driving the ball moveable strip 82, with an adhesive means, establishing a proper plane of declination for the correct movement of the hands, the clubheadface and clubshaft on its return to the ground.

5. The apparatus in claim 3 wherein the said diagrammed mirror aiding a golfer in proper techniques for putting;

wherein said vertical line 62 defining a space for the location of a golfer's eyes, a putterhead, a ball, and a hole.

6. The apparatus in claim 3 wherein the said diagrammed mirror aiding a golfer in propelling a ball within a distance of 50 meters; wherein said vertical lines 61 and 62 defining a space for the location of a ball and a flag.

7. The apparatus in claim 3 wherein the said mirror's back including a plurality of ribbings providing support of mirror's plane.

8. The apparatus in claim 3 wherein housing of the said mirror in a U-shaped frame assembly including:

(a) a pair of inwardly lipped vertical sides and an upwardly lipped bottom for encasing front, back, and lower edges of said mirror;

said bottom with a hinging means integrally permitting folding of bottom in the middle for a retraction of said sides; wherein sides contain vertical slots establishing a support means for the lower corners of said mirror when elevated during deployment;

(b) wherein each of said sides including a pair of folding leg supports forming a front and rear leg respectively; wherein said legs are pivotally attached at their top ends with said sides forming a a transverse axis for adjusting the frame relative to the vertical; wherein a frontal crossmember connecting horizontally to the said front legs'anterior and extending sufficiently beyond legs for supporting a pair of axle arms when the legs are opened; wherein said axle arms connecting to a handle's ends at the said assembly's front and a rear horizontal crossmember's ends at the assembly's posterior forming a rectangular arrangement that is pivotally joined to said rear legs for encompassing said front legs and containing their opening width; wherein said handle rotably moving out and downward for deployment of said frame assembly and moving up and inward during the folding of said legs for transport;

(c) a horizontal crossbar supporting the upper extents of said mirror's back during the deployment of said assembly; wherein a pair of ears pivotally attached at one of their ends to said rear legs and yoked to said crossbar at their other ends; wherein a locking means for establishing support of mirror's back at different angles relative to the vertical; wherein an elastic cord stretching across the mirror's front and attaching beyond its edges to said crossbar for coupling of mirror to crossbar.

9. The apparatus in claim 8 further comprising a pair of elastic cords stretching horizontally from side to side of said frame assembly for the yoking of said assembly sides to said mirror's edges.

10. The apparatus in claim 8 wherein said support legs further comprising solid inserts within their lower ends and rubber tips; wherein angled holes passing through said ends for accomodation of stakes in stabilizing device when used outdoors.

11. The apparatus in claim 8 wherein said handle further comprising a strap for transporting said frame assembly.

12. Sports training apparatus comprising: a large substantially reflective surface that is adapted to reflect a golfer's side which is opposite the direction he is driving the ball; a headgear support means for a pair of angularly arranged mirrors; wherein a member of said pair is so disposed that the light rays emanating from the said reflective surface is directed horizontally onto the said mirror member; wherein the angular spacing between said pair is within a range of an acute angle and is so arranged that light rays reflected from said member of said pair is directed horizontally onto said member's mate; therewith positioning of said mate is in full view of the user as he performs; wherein said reflective surface further comprising a diagram including a pair of substantially vertically straight guidelines for defining a space for the golfer's shoulders, vertebrae prominence, and feet; wherein substantially horizontally straight guidelines equidistantly spaced and placed between said pair of vertical lines providing a measure for a proper amount of lowering of the golfer's torso when he flexes his knees; substantially horizontally and vertically straight lines establishing a grid for the location of a ball; wherein said diagram further comprising two adhering moveable strips; one establishing the proper backswing plane for a clubshaft, a clubhead, and, the golfers leading arm during the upper extents of the backswing; the other strip establishing the proper path for a golfer's hands, the clubshaft and clubhead during the return of the club to the ground.

13. The apparatus in claim 1 wherein said device is adapted to reflect a baseball pitcher's front for providing a means for self observance while performing.

14. A sports training apparatus comprising: a large mirror disposed to reflect an image of an athlete and is adapted to rest on the ground or to be supported by a stationary structure; one or more moveable strips which aide in the visualizations of proper swing motions; a pair of angularly arranged mirrors which are suspended in the air by a supportive means; wherein a member of said pair is so positioned that the light rays reflecting from said large mirror are directed horizontally onto said mirror member; wherein the angular spacing between said pair of angular mirrors is within a range of an acute angle and so arranged that the light rays reflected from said mirror member are directed horizontally onto said member's mate; therewith the positioning of said mate is in full view of the user as he performs.

15. The apparatus of claim 12, wherein said angular mirrors'supportive means is a visored head-gear.

* * * * *